US006845693B1

(12) United States Patent
Babij, Jr.

(10) Patent No.: US 6,845,693 B1
(45) Date of Patent: Jan. 25, 2005

(54) SCREW GUIDE

(76) Inventor: Alex Babij, Jr., 3 Glen St., Galston, NSW 2159 (AU)

( * ) Notice: Subject to any disclaimer, the term of this patent is extended or adjusted under 35 U.S.C. 154(b) by 387 days.

(21) Appl. No.: 10/018,234

(22) PCT Filed: Jun. 16, 2000

(86) PCT No.: PCT/AU99/00676

§ 371 (c)(1),
(2), (4) Date: Dec. 14, 2001

(87) PCT Pub. No.: WO00/78509

PCT Pub. Date: Dec. 28, 2000

(30) Foreign Application Priority Data

Jun. 17, 1999 (AU) ..... PQ2118
May 9, 2000 (AU) ..... PQ7392

(51) Int. Cl.[7] ..... B25B 23/08
(52) U.S. Cl. ..... 81/434; 81/57.37
(58) Field of Search ..... 81/433–435, 57.33, 81/57.37; 227/136

(56) References Cited

U.S. PATENT DOCUMENTS 2,641,290 A * 6/1953 Webb ..... 81/451
2,770,269 A * 11/1956 Austin ..... 81/433
3,056,441 A * 10/1962 Helms ..... 81/429
3,757,407 A * 9/1973 Bomar ..... 221/279
3,907,014 A * 9/1975 Manino ..... 81/433
4,862,774 A * 9/1989 Else et al. ..... 81/57.37
5,031,489 A * 7/1991 Young et al. ..... 81/430
5,584,221 A * 12/1996 Petrantoni ..... 81/434
5,660,090 A * 8/1997 Deri ..... 81/434
5,819,609 A * 10/1998 Habermehl ..... 81/434
5,862,724 A * 1/1999 Arata et al. ..... 81/434

FOREIGN PATENT DOCUMENTS

GB 1233474 A * 5/1971 ..... B25B/23/10
GB 1507022 A * 4/1978 ..... B25B/23/10

* cited by examiner

*Primary Examiner*—David B. Thomas
(74) *Attorney, Agent, or Firm*—James Earl Lowe, Jr.

(57) ABSTRACT

The present invention provides a screw alignment device (10) for use with a screw driving tool and a screw (71) during a fastening operation, with said screw being of the type having a shank disposed between a screw head and a distal end, the screw driving tool being of the type having a shaft with a gripping formation at one end thereof and a screw engaging formation at the other end thereof for engagement with the screw head, said screw alignment device including a screw guide having a body of generally annular configuration formed from a resilient material and having an internal cavity (14) of generally frustoconical configuration tapering convergently towards a forward end of the screw guide (17); a tool guide (20) spaced rearwardly from the screw guide and aligned generally with the cone axis (18); and a connector which connects the screw guide to the tool guide; where, in use, a screw can be located in the screw guide so as to be aligned generally with the cone axis, the distal end of the screw projecting through said forward end and the head of the screw being held by the screw guide, and said tool guide receiving said tool so that when engaged with the screw head said tool, said screw and said screw guide are held together with said tool and screw aligned, and by driving the screw forwardly into a surface to receive said screw, the head of the screw will cause the screw guide to flex outwardly to permit the screw to pass through the screw guide.

33 Claims, 9 Drawing Sheets

10
12
16
18
19
20
22
32
34
35
40
42
70
71
72
74
76
76a
400
402
404
406
408
410
500
502
504
106
200
250

130
156
156
152
144
148
150
158
158
146

156
160
152
144
148
150
146

152
162
162
156
144
148
158
150
159
161
146
154
130
163

156
162
162
148
154
158
146
158
163
163

156
162
162
146
154
144
148
158
158
163
163

SCREW GUIDE

FIELD OF THE INVENTION

The invention relates to guides for assisting engagement of a screw driving tool with a screw fastener during a fastening operation and also to a cartridge for presenting screws sequentially to the guide.

BACKGROUND OF THE INVENTION

In a fastening operation such as when a person drives a screw into a solid body using a screwdriver or power tool, it is often difficult for the person driving the screw to properly hold the screw whilst it is being driven, particularly during the starting period of the driving operation. This problem is particularly acute when the screw is to be driven into an inaccessible location such as a corner, for example.

Ensuring that the screwdriver properly engages the head of the screw can be difficult as it can require a fair degree of dexterity while the user attempts to locate the screw in the desired position for fastening. Holding the blade of the screwdriver in the head of the screw can also present difficulties.

Devices to facilitate the starting of a screw in a fastening operation are known and one such device is disclosed in U.S. Pat. No. 4,139,036 (Regan). The Regan document discloses a device for a frictional fastening comprising a housing having an annular cavity extending therethrough for locating a screw inside and two oppositely disposed top and bottom openings located along a central axis of the housing. Mounted inside the housing at a distance above the bottom opening is a horizontal flexible sheet having a cross slit for receiving a screw aligned with the central axis and the openings.

A disadvantage of this device is that due to the predetermined size of the bottom opening in the housing, the guide is limited by the size of the screw that can be passed through the guide.

SUMMARY OF THE INVENTION

According to first aspect of the present invention, there is provided a screw alignment device for assisting engagement of a screw driving tool during a fastening operation with a screw of the type having a shank disposed between a head end and a front end, the screw driving tool being of the type having a shaft with a gripping formation at one end thereof and an engaging formation at the other end thereof for engagement with the screw head, the screw alignment device including:

- a screw guide having a body of generally annular configuration formed from a resilient material and having an internal cavity of generally frusto-conical configuration tapering convergency towards a forward end of the;
- a tool guide spaced rearwardly from the screw guide and aligned generally with the cone axis; and
- a connector which connects the screw guide to the tool guide;

where, in use, a screw is located in the screw guide so as to be aligned generally with the cone axis, the front end of the screw projecting through said forward end and the head of the screw being held by the screw guide, and a tool with its shaft supported by the tool guide can be engaged with the screw head thereby holding the tool and screw aligned, and by driving the screw forwardly, the head of the screw will cause the screw guide to flex outwardly to permit the screw to pass through the screw guide.

Preferably the screw guide body includes having a slit there through aligned generally parallel with the cone axis. The slit can be used to pass a screw into the screw guide. The slit can also be used to allow the body to flex outwardly depending upon the material used.

The tool guide can comprise a pair of jaws defining a gap there between in which the shaft of the screw driving tool is located in use. The jaws can be resiliently movable apart from each other to increase the width of the gap so as to be able to accommodate a range of shaft diameters. The jaws can have located thereon guides which form a convergent path. This can assist in moving apart the jaws to allow easy entry of a screw. The tool guide can be adapted to hold the screw alignment device to the tool or, alternatively, can be adapted to allow the tool to rotate relative to the screw alignment device during a screw driving operation.

Advantageously, the tool guide is formed of a resilient material. Such materials can include sheet metal, plastic, moulded plastic.

Preferably the connector is an elongate shank having an axis parallel to the cone axis. Hence, a screw loading region is defined between the screw guide and the tool guide, for loading screws into the screw guide.

More preferably, the screw guide and the tool guide are formed on the opposite ends of the elongate shank. This can reduce the tooling required in the manufacture of the alignment device. The tool guide can include formations which assist the tool guide in slidably clamping the tool guide to a tool. Such formations can include U-shaped formations to wrap partially around the tool.

According to a further aspect of the present invention there is provided a cartridge for presenting a plurality of screws in succession to a screw loading region of a screw alignment device as described above, the cartridge comprising:

- a hollow housing having a screw feed channel within the interior of the housing and defining an opening being provided through a wall of the housing into the channel;
- moving means to move screws located in the feed channel towards the opening; and
- connection means for connecting the cartridge to the screw alignment device, where in use, the plurality of screws are stored in individual succession on the screw feed channel so that each successive screw is moved towards the opening for insertion into the screw loading region of the screw alignment device in a fastening operation.

The moving means can be a biasing means. Advantageously the biasing means is a spring. More advantageously the spring is located at an end of the housing opposite the loading region.

Preferably said one housing end is attached to the guide by a locking cap provided with an annular channel having and an axis aligned with the cone axis of the guide when, it is located thereon. More preferably an engaging formation protrudes within the annular channel in a transverse plane to the axis, for engaging the body of the screw guide.

Advantageously the screw carrier means comprises two lengths of oppositely disposed tracks having inner edges that are spaced apart such that the head of a screw can be located on each of the tracks between the space.

Preferably a tool passes into said tool guide with said cartridge and or said tool guide being biased to slide alone said tool.

Preferably said tool is rotatably supported in a tool housing slidably engaging said cartridge.

The moving means can be one or more inclined planes associated with said tool housing, said inclined plane engaging a screw in said hollow housing so that as said plane moves towards said screw said screw is moved towards said opening.

Preferably a second inclined plane acts on a second screw so that as said second inclined plane moves away from said second screw, said second screw will force the first mentioned screw to enter through said opening and be positioned in said alignment guide.

Preferably one or more of said inclined planes are formed on two prongs with a space between said prongs, allowing a shank of said screws to be located in said space.

Where in the specification the word "comprising" or "comprises" is used, this is to be interpreted to have a non-exclusive meaning.

BRIEF DESCRIPTION OF THE DRAWINGS

Notwithstanding other embodiments which may be encompassed in the scope of the invention as defined broadly above, one embodiment of the invention will now be described by way of example only with reference to the accompanying drawings in which.

DETAILED DESCRIPTION OF THE EMBODIMENTS

Figure 2:
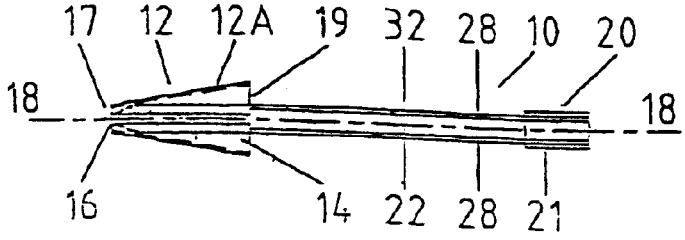
FIG. 2 illustrates the screw alignment device of FIG. 1 in plan view.
Figure 1:
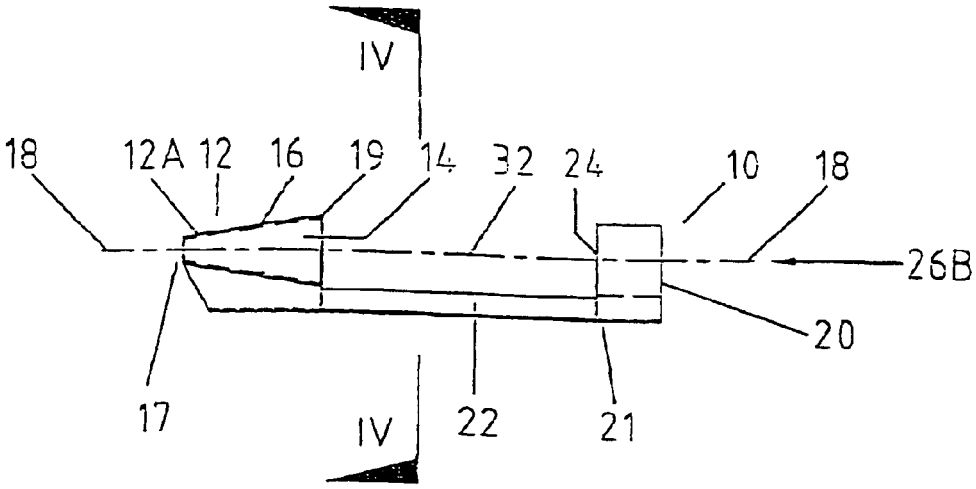
FIG. 1 illustrates in side view a screw alignment device for assisting engagement of a tool during a fastening operation with a screw according to the present invention.
Figures 9, 10, 11, 19, 20, 21:
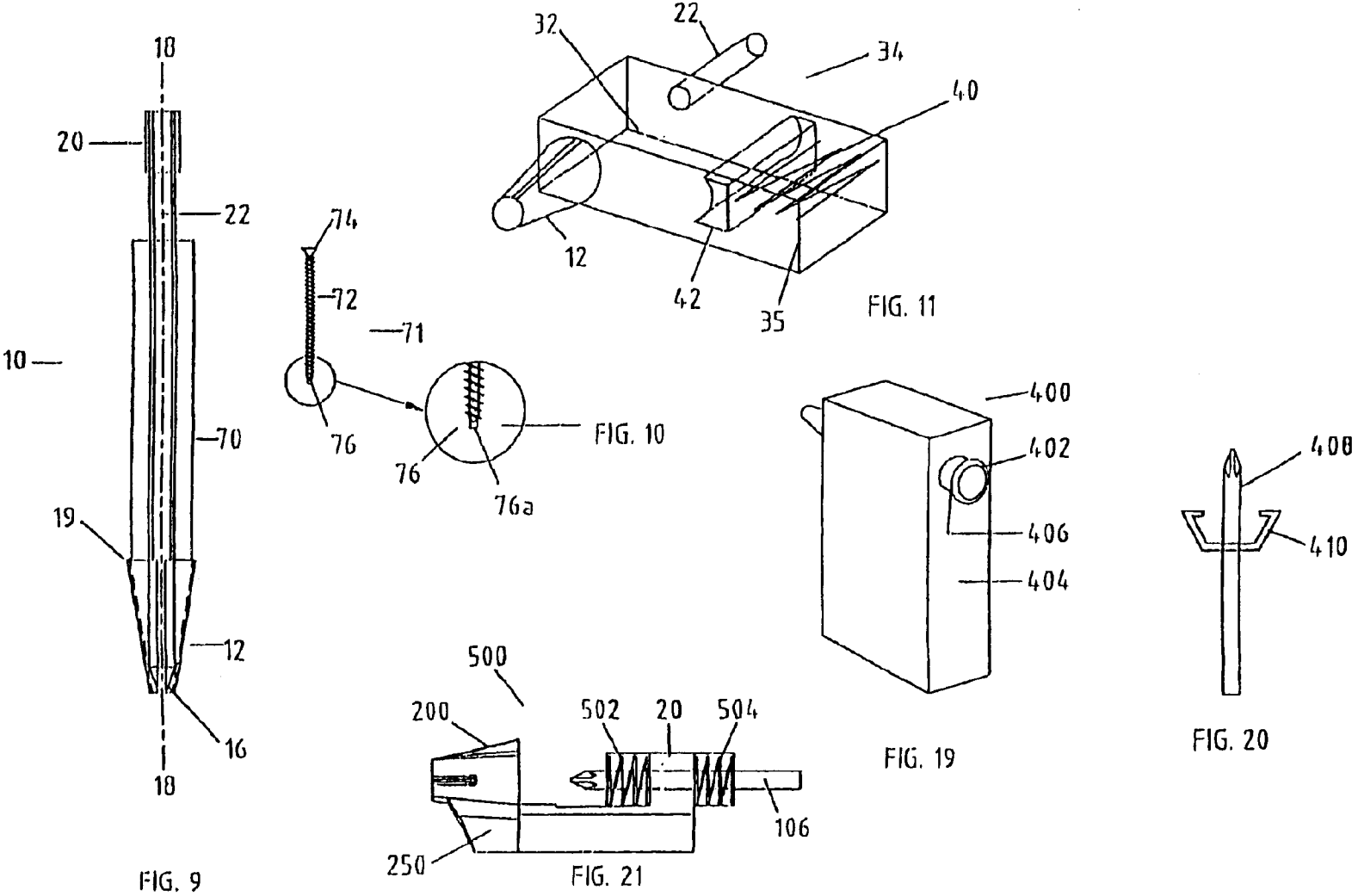
FIG. 9 illustrates another embodiment of the screw alignment device in accordance with the present invention, showing a screw of a type which can be used with the invention.
FIG. 10 illustrates a detail of the screw illustrated in FIG. 9.
FIG. 11 illustrates a perspective view of another embodiment of the invention in which the guide and cartridge are integrated into a single unit.
FIG. 19 illustrates a schematic of a cartridge and screw alignment guide having a connector to receive a screwdriver.
FIG. 20 illustrates a cross section of a screw driver and attachment to connect to the connector of FIG. 19.
FIG. 21 illustrates a side elevation of a screw alignment guide similar to that of FIGS. 1 and 16 or 17.

In FIGS. 1 and 2, there is illustrated a screw alignment device in the form of guide 10, for assisting the engagement of a screwdriver with a screw such as a screw 71 shown in FIGS. 9 and 10, during a fastening operation. The screw 71 has a threaded shank 72 disposed between a head 74 and a tip 76, and the screwdriver (not shown), of the type having shaft disposed between a gripping handle and an engaging end which can engage the head 74, so that the screw 71 can be turned in a clockwise direction in a fastening operation with a solid body.

The guide 10 has a screw guide 12 having a frusto-conical shape body 12A which tapers convergently towards end 17 of the screw guide 12. The screw guide 12 is formed with a conical internal cavity 14 being of a frusto-conical configuration that convergently tapers towards end 17.

The screw guide 12 also has a slit 16 formed through the body, extending through to the cone 14 along the length of the body, from end 19 to end 17 of the screw guide 12.

A cone axis of the screw guide 12 is illustrated by the dotted line 18.

There is also provided a tool guide 20 aligned generally with an axis 18 (being the cone axis of the generally frusto-conical shaped body 12A) and disposed at an opposite end 21 of the guide 10. Connecting the tool guide 20 to the screw guide 12, is an elongated connector 22.

Figure 5:
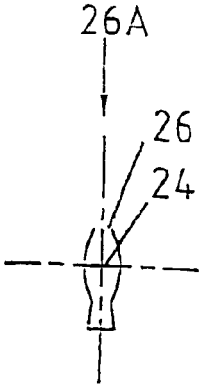
FIG. 5 illustrates a rear elevation of the screw alignment device of FIG. 1.

The tool guide 20 includes a cavity 24 (as shown in FIG. 5), which extends through the tool guide 20 so as to receive and locate a shaft of a screwdriver when in use. It can be seen from FIG. 5, that the cavity 24 is open at 26 for allowing the shaft of the screwdriver to be clipped into the cavity 24 by movement in the direction of arrow 26A (of FIG. 5), where a shaft of a screwdriver will force open the opening 26 and enter therein. Alternatively, a shaft of a screwdriver can be inserted through the cavity 24 in the direction of arrow 26B of FIG. 1.

The tool guide 20 can be formed from a resilient material which enables the tool guide to springingly grip the shaft of a screwdriver in a jaw-like or pincer like manner and allows relative movement of the shaft with the tool guide 20. This relative movement includes the ability of the shaft to slide through tool guide 20 and/or rotate in tool guide 20.

Additionally the screw guide 12 is also formed of a resilient material for allowing the screw guide 12 to flex and the slit 16 to open as the head 74 of the screw 71 is driven by the screwdriver towards end 17 in a fastening operation as described below.

Suitable resilient material for the screw guide 12 and the tool guide 20 can be a resilient steel such as SAE 1074 flat high carbon spring steel strip having a thickness of 0.25 mm and a yield stress between 1600 to 1980 MPa. Alternatively, the material can be a plastic material of suitable resilience.

Additionally it should be noted that the guide 10 also defines between the end 19 of the screw guide 12 and the end 21 of the tool guide 20 a loading region 32 for allowing the screws to be loaded into the screw guide 12.

Figure 3:
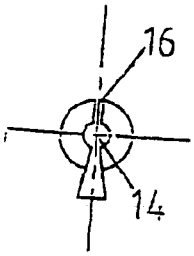
FIG. 3 illustrates a front elevation of the device of FIG. 1.

In FIG. 3 it can be seen that the cone 14 allows a screw to be located therethrough and that the slit 16 extends through the body of the tool guide 20.

Figure 4:
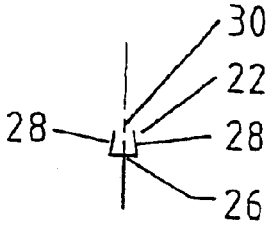
FIG. 4 illustrates a cross section of the screw alignment device of FIG. 1 sectioned through plane IV—IV.

Illustrated in FIG. 4 the connector 22 has a base 26 and a pair of projections 28 extending from each edge of the base 26 to define a channel 30 between each projection 28. The connector 22 can be made of steel material or plastic and is preferably made from the same material as that of the tool guide 20 and screw guide 12. The connector 22 is preferably integrally formed with the screw guide 12 at end 19 and with the tool guide 20 at 21, however as will be seen from the function of the connector can be achieved by a portion of a housing of a cartridge.

In use, a screw such as screw 71 of the type shown in FIG. 10 (or any other screw) is placed into the screw guide 12 such that the front end 76 of a screw 71 is adjacent or projecting through the end 17 of the cone 14 and the generally circular periphery of head 74 of the screw 71 is engaging the cone 14. The threaded shank 72, head 74 and front end 76 are aligned along the axis 18 while the shaft of the screwdriver (not shown) is located in the cavity 24 and the engaging end of the screwdriver engages the head 74. There is sufficient friction or compressive force generated by the tool guide 20 with respect to the shaft of the screw driver, to keep the screw 71, guide 10 and screw diver in the same relative positions to thereby keep the screw 71 and the screw driver engaged.

The screw 71 is driven into a surface to receive the screw 71 by rotating the screwdriver in an appropriate (generally clockwise) direction so that the front end of the screw moves axially forward in a direction along the axis 18 towards end 17. Once end 17 engages the surface receiving the screw 71, the head 74 will moves in the direction from end 1910 end 17. Due to the resilience and/or elasticity of the material and/or the shape of the screw guide 12, the slit 16 expands as the head 74 moves relative to the sides of the cone 14.

It will be appreciated that in other embodiments of the invention, the tool guide 20 can be slidingly attached to the shaft of the screwdriver (with no ability to rotate relatively) so that the guide 10 can be rotated with the screw about the screw shaft 72 so as to drive the screw 71 into the solid body.

As the head 74 moves closer to the end 17, the side edges of the slit 16 are spread further and further apart until the head 74 is completely driven through the cone 14 at which tire the slit 16 suddenly retracts due to the resilience of the material, thereby producing an audible "click" sound.

It is thought that the audible click is a result of the slit 16 snapping back into its original position once the head 74 has been driven through the end 17. Sound can also be produced as a result of the sides of the cone 14 being scrapped by the head 74 of the screw 71 in a fastening operation.

It is an advantage of the invention that the click sound indicates to the user that the screw has been driven into the solid body. It will be appreciated that the audible click that is produced enables the user to know when to stop rotating the screw into the solid body and thereby prevent the user from applying an excessive force in rotating the screw and possibly stripping the thread of the screw 71 and/or the surface into which the screw 71 is driven.

Furthermore, the slit 16 which expands also enables different sized screws having different sized heads to be used with the same guide 10.

Figure 6:
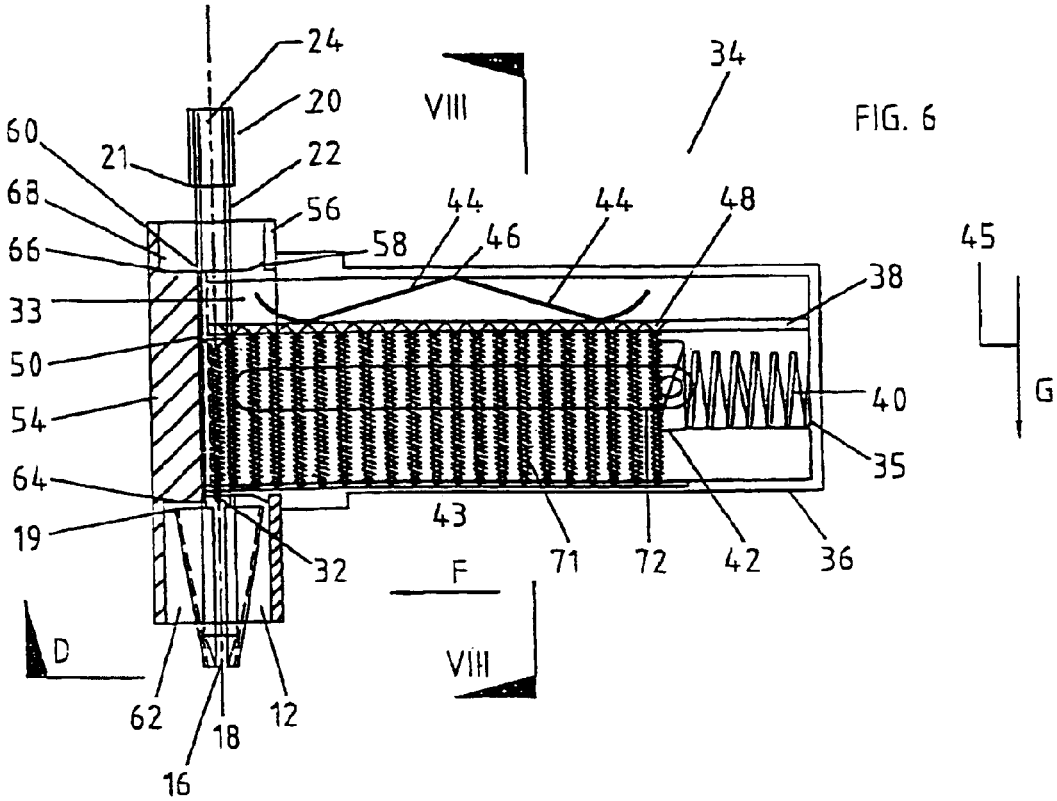
FIG. 6 illustrates in cross-section, a cartridge for presenting a set of screws to a screw loading region of the screw alignment device of the present invention.

Referring now to FIG. 6, there is illustrated a cartridge 34 for presenting screws to the screw loading region 32 of the guide 10. The cartridge 34 has an elongate hollow housing 36 open at end 33 and having a biasing means in the form of spring 40 attached at end 35.

Within the housing 36 there is also provided a screw carrier means in the form of two lengths of oppositely disposed tracks 38 (see FIG. 8) which extend throughout the length of the housing 36 to the screw loading region 32. The tracks 38 are biased or formed within the housing 36 by a cantilevered spring 44 which is attached to a top section of the housing at point 46. The cantilevered spring 44 will allow one housing 36 to be used for a range of screw lengths.

Figure 8:
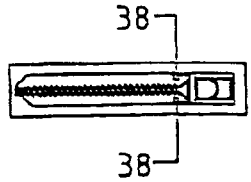
FIG. 8 illustrates a cross section through the cartridge of FIG. 6 sectioned through plane VIII—VIII in FIG. 6.
Figure 7:
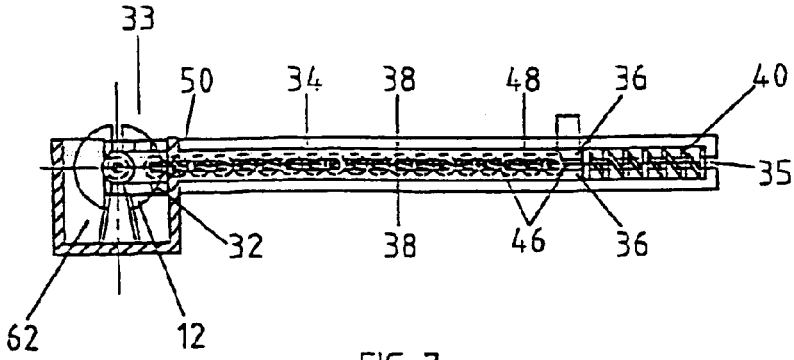
FIG. 7 illustrates a front elevation of the cartridge and screw alignment device shown in FIG. 6.

A plurality of screws 71 are located within the housing 36 by locating the head of each of the screws between the tracks 38 shown whereby the shanks 72 of the screws 71 are located in the space 46 between tracks 38 as illustrated in FIGS. 7 and 8.

On the end of the spring 40 is located a moveable lug 42 for contacting the screw 48 closest to the spring 40 of the set of screws 71 located on the tracks 38. The screw 48 has a threaded shank 72 which is contacted by the lug 42 which pushes the set of screws in a direction shown by arrow "F" due to the bias of the spring 40. This ensures that the screw 50 at the opposite end of the tracks is pushed into the loading region 32, thereby enabling screw 50 to be driven into a surface using the guide 10 described above.

A lockable cap 54 is attached to the openable end by pushing a resilient lug 56 over projection 58 located on the external surface of the housing 36. In this way, the guide 10 is locked into the cartridge 34.

In this configuration, the lockable cap 54 has a channel 60 which is aligned with the axis 18 so that the connector 22 can lie therein. The end 19 of the cone is located within an outer annular channel 62 so that the end 19 abuts or is adjacent to the projection 64. In use, the guide 10 is prevented from moving out of the lockable cap 54 as the end 21 presses against an annular wall portion 66 located in outer annular channel 68, when the guide 10 is moved in an axial direction shown by arrow 45.

In use, a plurality of screws 71 are loaded onto the tracks 38 and the guide 10 is located in the lockable cap 54 as described above. When the screwdriver is slidably removed from the loading region 32 after fastening a screw into a surface, the spring 40 biases the lug 42 in the direction of arrow 43, thereby forcing the next screw into the loading region 32, so that it can be used as the next fastening screw.

It will be appreciated that an advantage of the cartridge 34 is that it allows the automatic loading of the screws 71 into the loading region 32 and thereby reduces the loading time required to load the guide 10 in a fastening operation.

Although in this example of the invention, a screw of the type shown in FIG. 10 has been described, it will be appreciated that other types and forms of screws can be used in this embodiment of the invention.

FIG. 9 illustrates another embodiment of the guide 10. For convenience, the parts of the guide have been labelled with like reference numerals as that of the embodiment of the guide 10 shown in FIGS. 1–5.

The difference in the embodiment of FIG. 9 to that of the guide 10 illustrated in FIGS. 1 to 5, is that the connector 22 is substantially longer and has an enclosed casing 70 which allows for a plurality of screws (of the type shown in FIG. 10) to be loaded into the guide for maintaining each of the screws in succession along the length of the connector 22. It should also be noted that the a tip 76 will need to have a drive 76*a*. The drive can be seen more clearly in the enlargement circle of FIG. 10.

The drive 76*a* is adapted to fit into a corresponding head 74 of another screw, so that the screws can be each located within the connector 22 and successively enable each corresponding screw to be turned axially forward by a screw driver during a fastening operation. This enables successive fastening of a plurality of screws.

FIG. 11 shows another embodiment of the invention similar to that described above however in this instance instead of a lockable cap provided at one end of the housing, the guide and the cartridge are integrally formed into a single unit.

Figure 12:
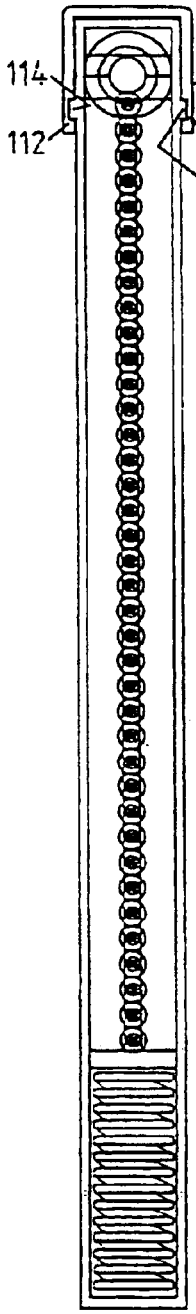
FIG. 12 illustrates a front elevation of another embodiment similar to that of FIGS. 6 which has a guide and cartridge integrated into a single unit.
Figure 13:
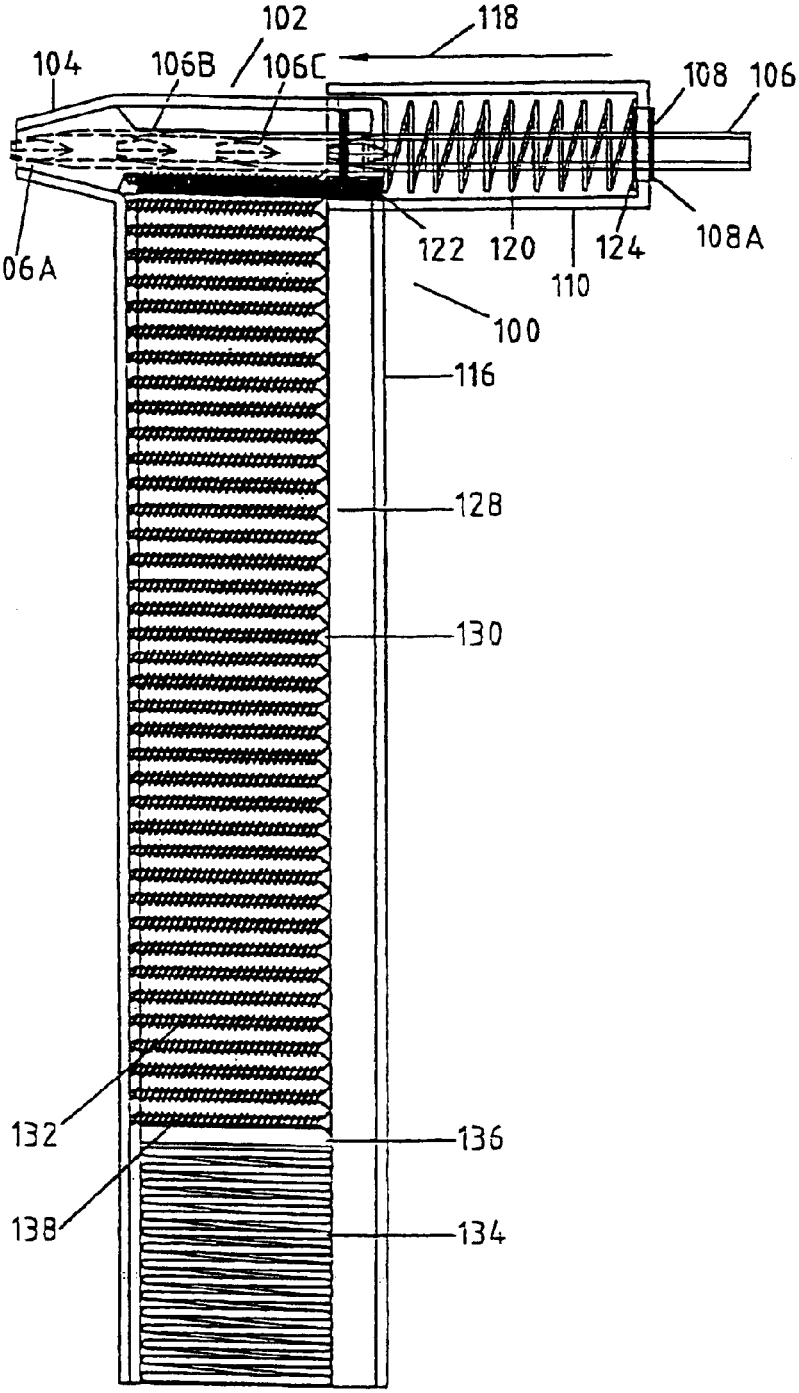
FIG. 13 is a right side elevation of the apparatus of FIG. 12.

Illustrated in FIGS. 12 and 13 is another cartridge and alignment guide 100. The alignment guide portion 102 has a frusto-conical portion 104 similar to previous embodiments which permits the passage of the screw head also as in previous embodiments.

Into the rear of the guide 102 is inserted a screwdriver 106, which is rotatably connected to a housing 110, in the region of washer 108A, by swaging the washer 108A to the screwdriver 106. The housing 110 has a longitudinal groove 112 (visible in FIG. 12) on each side to engage a longitudinal rib 114 on each side of the cartridge housing 116. The grooves 112 enable the housing 110 to slide in the direction of arrow 118 against the bias of a spring 120 so that when pressure is taken off the screwdriver 106 the housing 110 will retract to the position as illustrated in FIG. 13. The spring 120 abuts the rear portion 122 of cartridge housing 116 and rear portion 124 of housing 110. Between these two portions the spring 120 is compressible.

Figure 23:
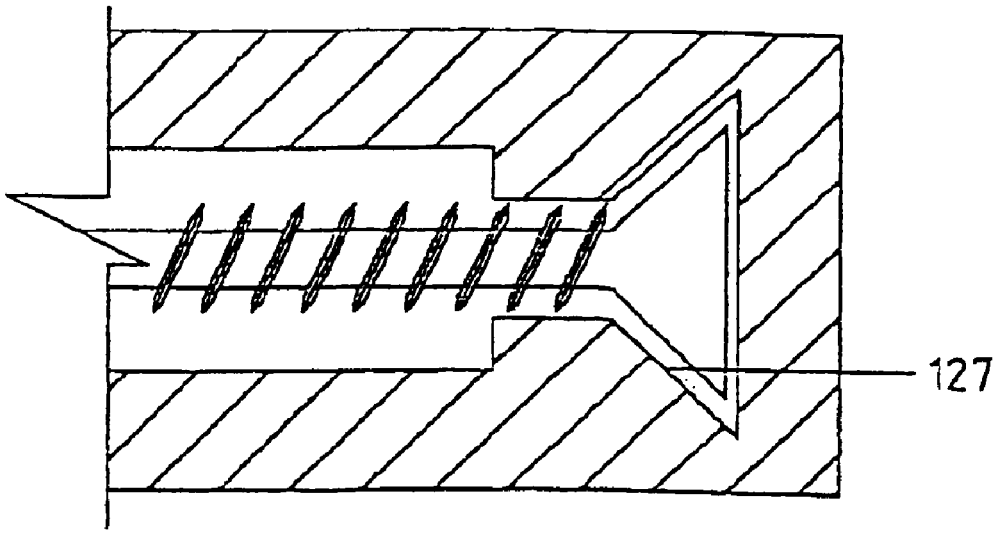
FIG. 23 illustrates a cross section through the cartridge housing 116 of FIG. 13 showing the cross section of a dove tail groove.

In the cartridge housing 116 is a track portion 128 which has a longitudinal dovetail groove 127 (visible in FIG. 23) having a similar or the same shape as the silhouette of a screw head 130 and is of a size to allow screw heads 130 to slide longitudinally along the groove. The use of the dovetail groove ensures that screws 132 will remain in approximately the orientation as illustrated in FIGS. 13 as they progress through the cartridge housing 116 along the track portion 128 to thus minimise the chances of the screws skewing and possibly jamming in the tracks 128. The base of the cartridge housing 116 includes a compression spring 134 and a shim 136 which pushes against the lower most screw 138 thereby urging all the screws 132 towards the screw alignment guide 102.

In operation the guide 100 functions so that once a screw 132 is in the alignment guide 102 the screwdriver 106 can engage the screw head 130 and then the screw 132 is driven into its final destination. The screwdriver 106 passes through the alignment guide 102 until the screw 132 exists frusto-conical portion 104. Phantom images of 106C, 106B and 106A indicate the positions of the screwdriver 106 as a screw 132 is driven into a surface in from right to left. As the screwdriver 106 is inside the loading region for the screws, screws not in the alignment guide are unable to enter therein until the screwdriver 106 is fully retracted to the tight hand side as illustrated in FIG. 13. As the screwdriver 106 progresses from right to left, from phantom images 106C to 106B to 106A, the housing 110 is also moving a similar distance, in view of housing 110 being secured to the screwdriver 106. As soon as the screwdriver 106 moves to the right past the dovetail groove 127 (see FIG. 23), the next screw 132 will be forced by spring 134 into the alignment guide 102.

Figure 14:
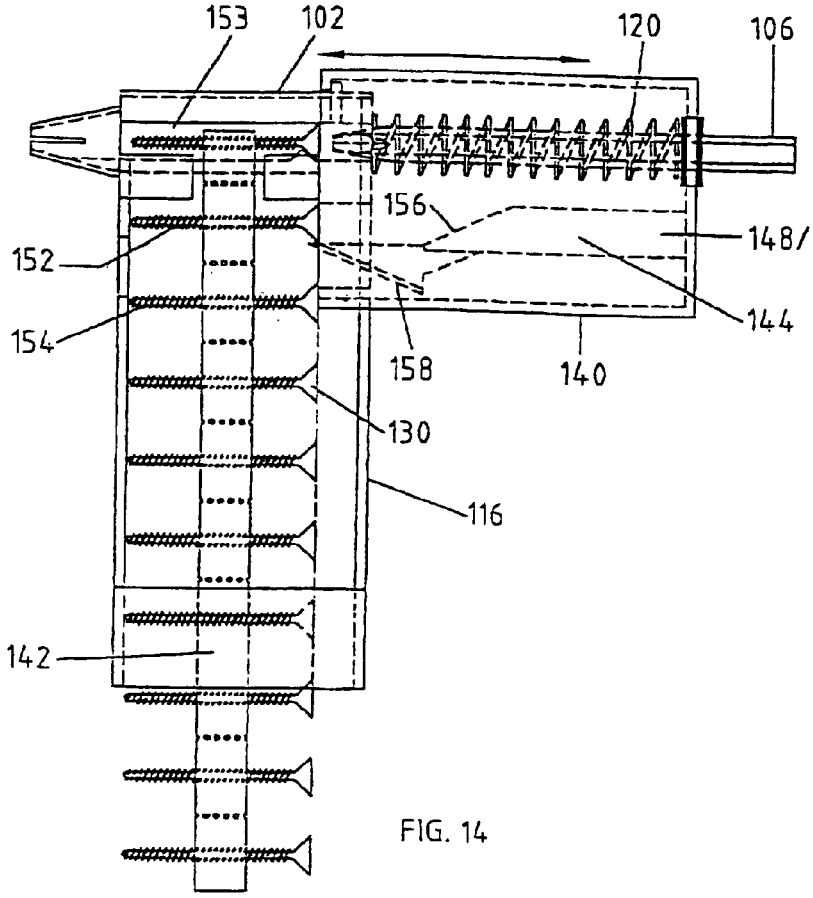
FIG. 14 is a right side elevation of a further embodiment of a cartridge and guide having an advancement mechanism to effect movement of screws.
Figure 15:
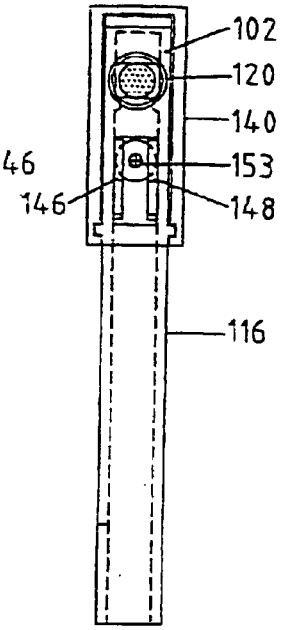
FIG. 15 is a front view of the apparatus of FIG. 14.

Illustrated in FIGS. 14 and 15 is another embodiment similar to that of FIGS. 12 and 13 and like parts have been like numbered. One of the main differences between the embodiment of FIGS. 14 and 15 and that of FIGS. 12 and 13 is that the housing 110 is replaced by a generally larger housing 140 which has an additional component therein. Another difference is that the screws are interlinked on a tape 142 with the screw heads 130 being spaced apart rather than in abutment as illustrated in FIG. 13.

The additional component in housing 140 is an advancement mechanism 144 which is better illustrated in FIGS. 15A, 15B, 15C, 15D and 15E. The mechanism 144 includes two inclined planes and is made from two members 146 and 148 with the member 148 being the mirror image of the member 146. A space 150 is provided between the members 146 and 148 with the members 146 and 148 being held by the housing 140 in this spaced apart relationship. The advancement mechanism 144 has a forward ramp surface 156 on each member 148 and 146 and connected to the lower-most forward-most portion of the main body of members 146 and 144 is a rearward ramp 158.

Figures 15A, 15B, 15C, 15D, 15E:
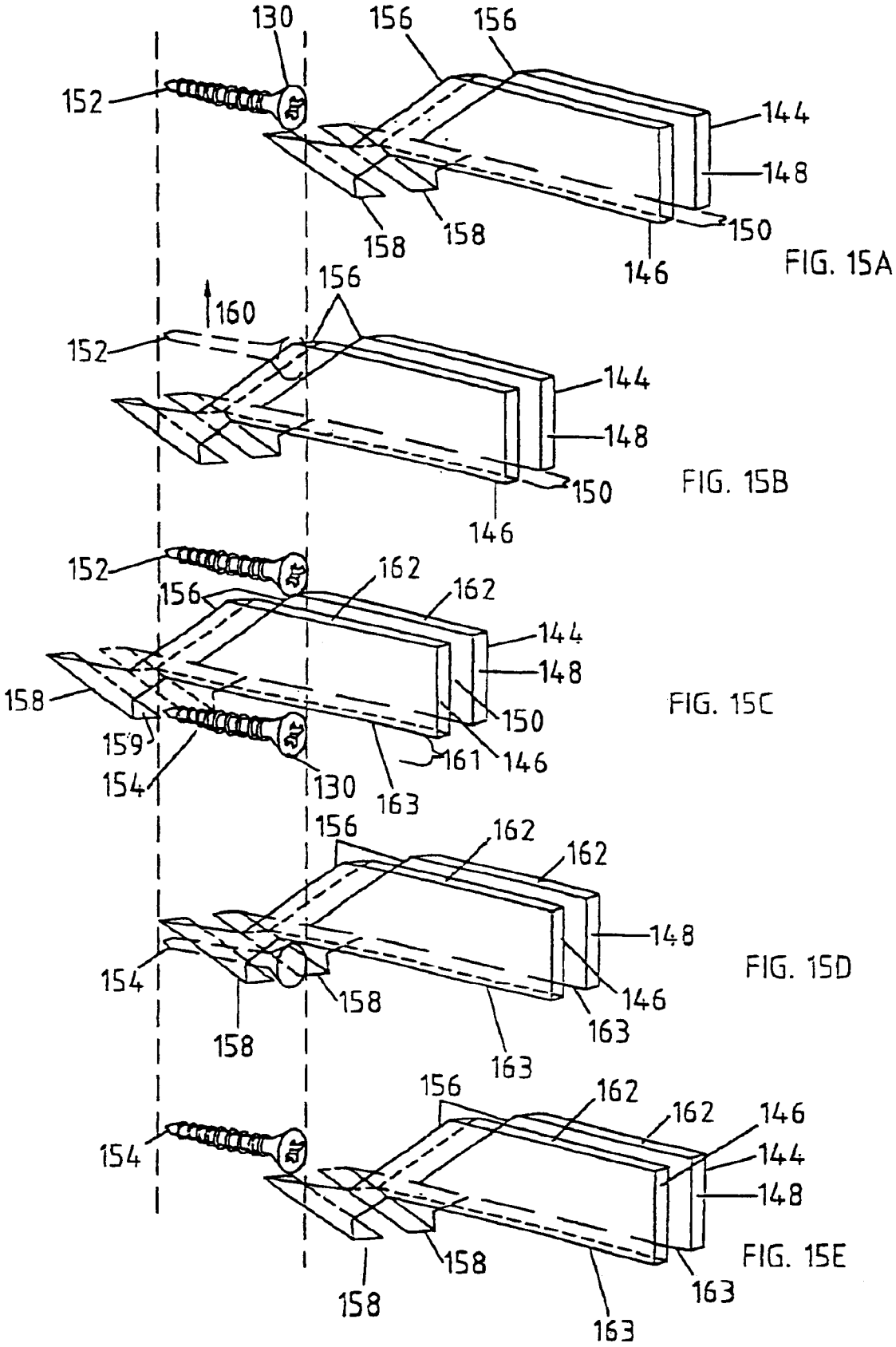
FIGS. 15A to 15E illustrate the movements of screws relative to the advancement mechanism.

The operation of the advancement mechanism 144 will now be described with reference to FIG. 14 and FIGS. 15A to 15E. In FIG. 14, there is illustrated a screw 152 adjacent to the advancement mechanism 144 with the next screw in line, being screw 154. Thus, in FIG. 15A, screw 152 and advancement mechanism 144 are in the positions illustrated in FIG. 14. As screw 153 of FIG. 14, which is located in the screw alignment guide 102, is being screwed into its final destination by the screwdriver 106, the advancement mechanism 144 moves towards the screw 152. When the screw 153 has been partially screwed into its destination, the base of ramp 156 engages the screw head 130. As the screwdriver 106 further secures the screw 153 into its destination, the advancement mechanism 144 continues to move from right to left as in FIG. 15B and the screw 152 is forced in the direction of arrow 160 towards the screw alignment guide 102. When the screw 153 has been fully inserted into its destination, the screw 152 will have moved, as illustrated in FIG. 15C, to the top of its movement in the direction of arrow 160 so as to be just above the top surface 162 of the member 146 and 148. At this point, and simultaneously therewith, in view of the screws 152 and 154 being connected by tape 142, the next screw 154 will have moved in the same direction as arrow 160 into the position as illustrated in FIG. 15C relative to the screw 152 and the advancement mechanism 144.

Once screw 153 has been ejected from the alignment guide 102, the screwdriver 106 relative to the cartridge housing 116 as seen in FIG. 14 will be moved from left to right under the influence of the compression spring 120 when the operator takes pressure off the screwdriver and the surface into which the screw 153 had been inserted. In the motion from left to right, the rearward acting ramp 158 moves from right to left as in FIG. 15D engaging the head 130 of screw 154. As the advancement mechanism 144 continues to move in the left to right direction, screw 154 is moved upward relative to the advancement mechanism 144 until the advancement mechanism 144 and screw 54 have adopted the position as illustrated in FIG. 5E. It is important to note that the movement of the screw 152 in FIGS. 15A through to 15C only moves the screw 152 to a location immediately before entry into the screw alignment guide 102. It is the movement of screw 154 from FIG. 15C through to FIG. 15E and by virtue of the interconnection of screws 152 and 154 by the tape 142 that pushes the screw 152 into the screw alignment guide 102.

The tape 142 is able to transmit compressive forces so as to push the screw 152 by the movement of screw 154 into the screw alignment guide 102.

The cartridge 116 need not be a straight line, as illustrated in FIGS. 12 and 13. The embodiment of FIGS. 12 and 13 and FIGS. 14 and 15 could utilise a spiral wound cartridge. Alternatively, for the embodiment of FIGS. 14 and 15, only the last portion of the cartridge 116 that is immediately before the screw alignment guide 102 need be rigidly constructed if a belt of screws being housed in a spiral wound or other fashion in a circular or other shaped container is also provided, with the belt of screws being fed or rolled out as each screw passes into the screw alignment guide 102.

It will be seen from FIG. 15C that the ramp 158 has its lower-most portion 159 such that the distance 161 from the lower-most point 159 through to the lower-most surface 163 of sides 146 and 148 is wide or deep enough so that the lowest-most point of the screw head 130 is above the lowest-most point 159 of the ramp 158 when the screw 152 has been moved to its further-most position by ramps 156.

Figure 16:
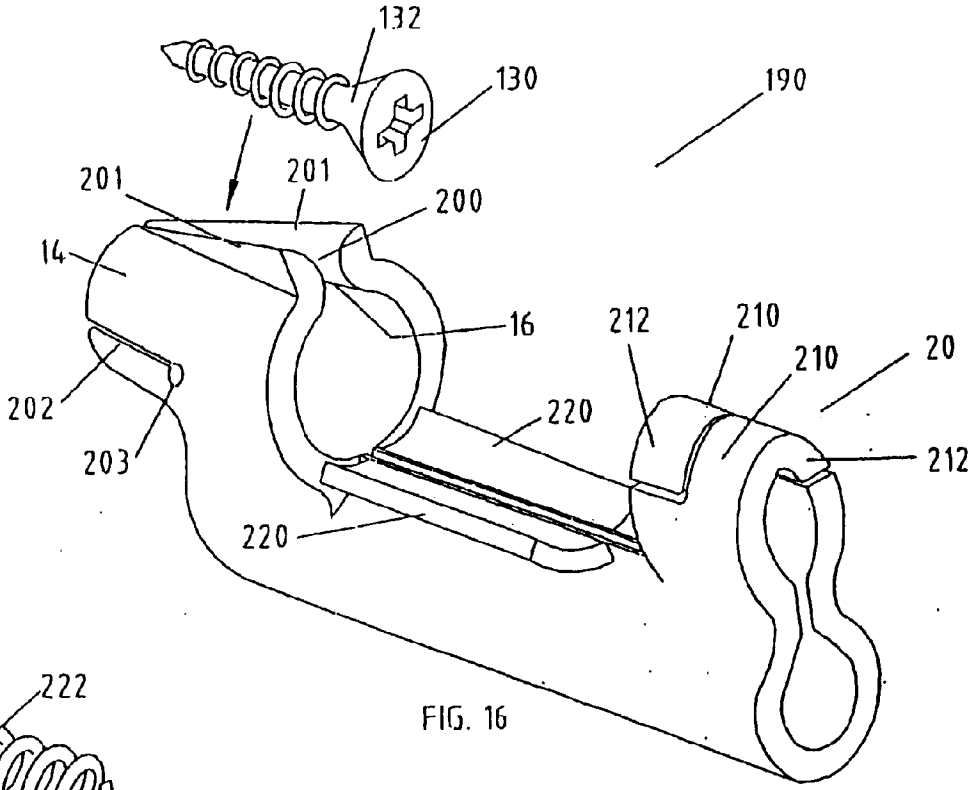
FIG. 16 illustrates a rear perspective view of an embodiment similar to that of FIG. 1 with additional improvements.
Figure 17:
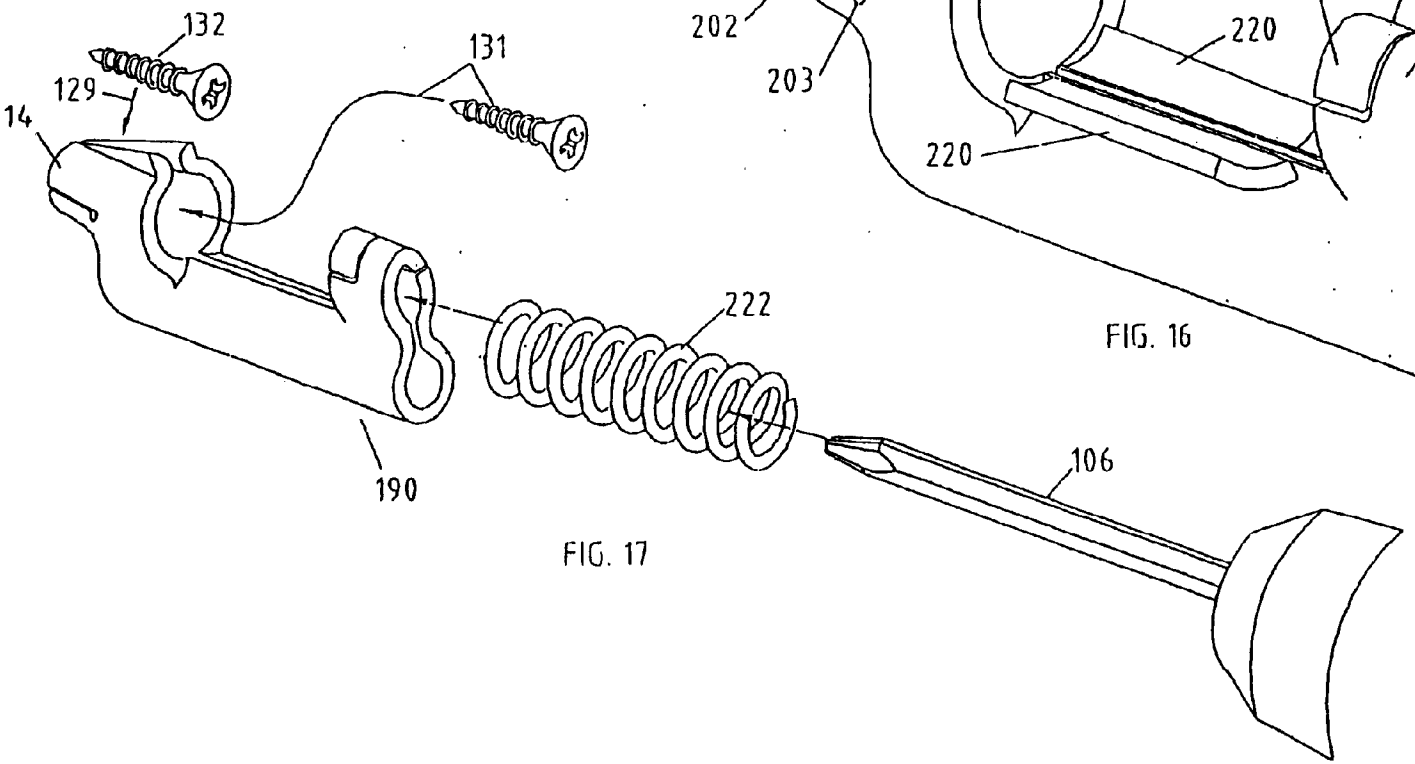
FIG. 17 illustrates a rear perspective view of the embodiment of FIG. 16 in use with a spring.

Illustrated in FIGS. 16 and 17 is an embodiment similar to the embodiment of FIG. 1. The embodiment of FIGS. 16 and 17 is manufactured from plastic and like parts have been like numbered with the embodiment of FIGS. 1 to 5. The differences between the embodiments of FIGS. 16 and 17 and that of FIGS. 1 to 5 is that the embodiment of FIGS. 16 and 17 includes a turned-out flanged inlet portion 200 having a flared entry surface 201 on each side of the opening 16. This facilitates the insertion of a screw 132 into the alignment guide 190 radially through the body 12A.

The body 12A includes two longitudinal slits 202 located on the body 12 at diagonally opposite locations, which terminate with a round hole 203 as a stress reliever to help prevent premature fracture. The slits 202 help to control the amount of elasticity and flexibility of the frusto-conical portion 14 as a screw passes through the frusto-conical portion 14.

The tool guide 20 includes at its top end, a right-hand side portion and a left hand side portion 210 which have downwardly extending legs 212 so as to wrap over the top of the screwdriver 106. By this means the tool guide 20 will firmly and slidably hold the screwdriver 106 in the tool guide 20.

If desired catchment lips 220 can be provided to support the screw head 130 when it is initially inserted inside the alignment guide 190. These attachment lips 220 help to facilitate the entry of a screw through the rear of frusto-conical portion 14 as indicated by arrow 131 of FIG. 17, by providing a reasonable sized platform to rest the screw on if necessary.

As illustrated in FIG. 17, the alignment guide 190 (with lips 220 removed) is illustrated as being able to be used with a spring 222 which will help to move the alignment guide 190 to the end of the screwdriver 106 once a screw 132 has been inserted. In FIG. 17, it can be seen that the screw 132 can be slid in direction of arrow 129 through the flared entry 200 or, if desired and the screw is of a sufficient size, can be inserted directly into the frusto-conical portion 14 in direction of arrow 131.

Figure 18:
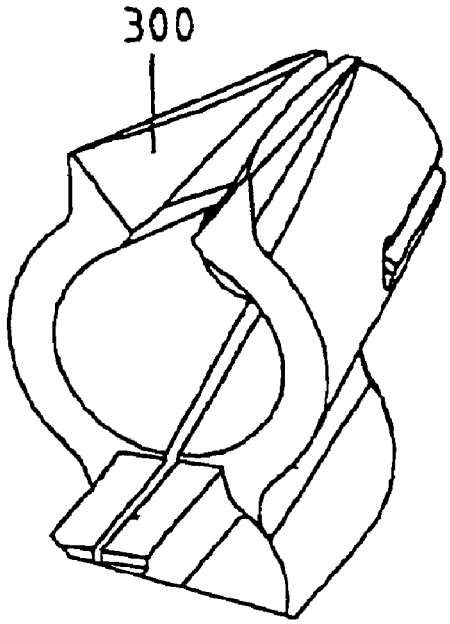
FIG. 18 illustrates a perspective view of a variation to the embodiment of FIG. 16.

As an alternative shape to the flared entry 200 of FIGS. 16 and 17 in FIG. 18 is illustrated another flared entry, having a tapered side entry portion 300. It is thought that the flared entry 300 will be easier to injection mould by comparison to the flared entry 200 of FIG. 16.

Illustrated in FIGS. 19 and 20 is an embodiment of a screw alignment guide and cartridge 400 which can have the features of the combination guide and cartridge in the description above. The alignment guide and cartridge 400 includes an annular fitting or formation 402 which projects away from the rear 404 of the cartridge body and has an annular lip 406 around its periphery. The lip 406 forms a connection flange to connect with a screw driver 408 and its mating fitting 410 as illustrated in cross section in FIG. 20. The screw driver 409 can rotate and slide relative to the fitting 410 but the two components are held together so as to not be able to extricate themselves during screw installation operations. This will allow the screw driver 408 and fitting 410 to be sold separately if desired.

Illustrated in FIG. 21 is a screw alignment guide 500 similar to that of FIGS. 16 to 18. In this embodiment the overall length of the alignment guide body 250 is reduced by comparison to other embodiments. In this embodiment the only way to place a screw in the alignment guide 500 is via a flared entry 200. This enables the guide to be manufactured smaller and thus more cost effectively than other embodiments. In this embodiment a screw driver 106 is slidingly and rotatably held in the tool guide 20 and is preferably not able to be released therefrom without destroying the screw alignment guide 500. The screw driver 106 can be biased in two directions by a first spring 502 and a second spring 504 which bear against opposite sides of the tool guide 20. Thus as soon as the pressure is taken off the screw driver 106 and screw guide 500, by the influence of the springs 502 and 504 the screw guide 500 will retract back to the same position each time on the screw driver 106, enabling the screw alignment guide to be re loaded with a new screw.

Figure 22:
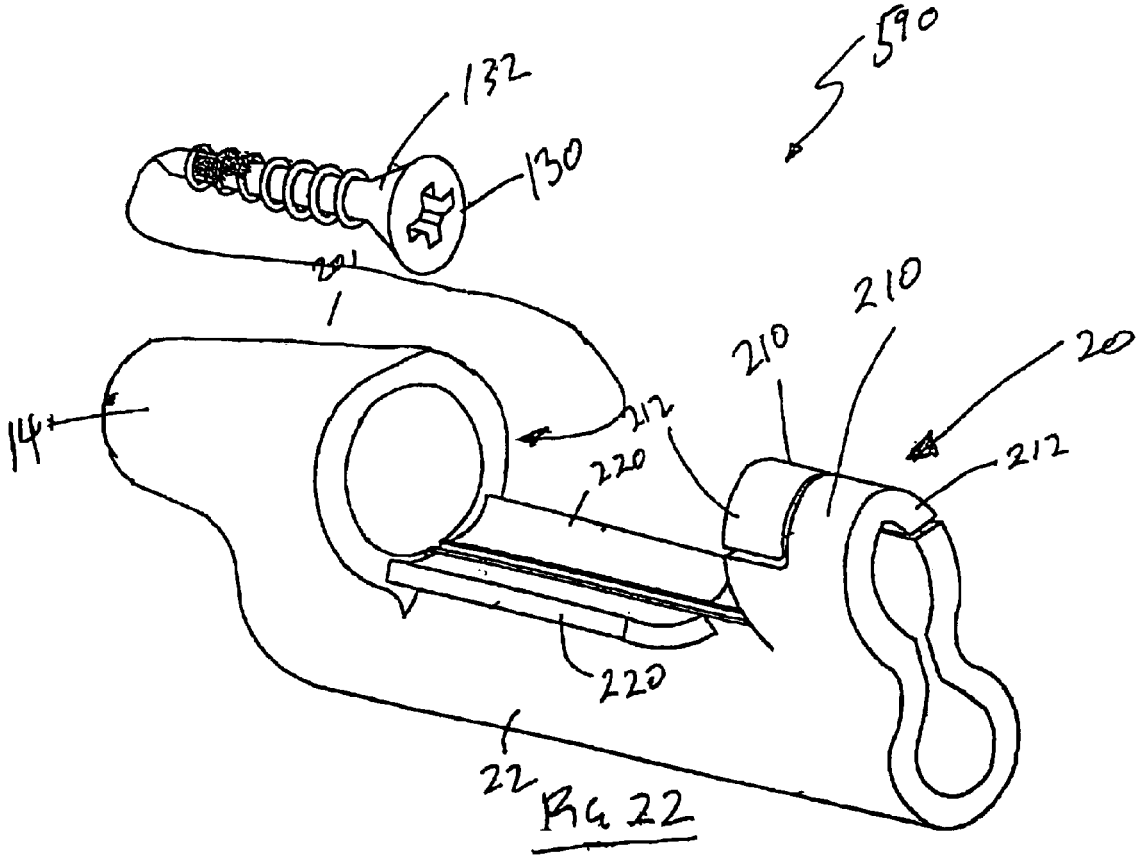
FIG. 22 illustrates a rear perspective view of a screw alignment guide similar to that of FIG. 16 wherein the body of the guide does not have any slit therethrough.

Illustrated in FIG. 22 is an embodiment of a screw alignment guide 590 which is similar to the screw alignment guide 190 of FIG. 16. The difference between screw alignment guide 590 and 190, is that the screw alignment guide 590 has a conical portion 14 without any slits therein. In this embodiment the material chosen for the screw alignment guide body is one having sufficiently high elasticity and high flexural strength to allow a predetermined size screw head to pass through the frusto conical portion 14. This embodiment may not be able to take the range of screw head sizes which the other embodiments are capable of but it should be sufficient for screw heads of a specific size to pass through the frusto conical portion and still be able to be used repetitively. This embodiment may not have as long a life as other embodiments, but it should still function to within a predetermined design life.

The embodiments of FIGS. 16, 17 and 22 are each made with a connector 22 which is of a generally tubular construction with the screw guide body 12A and the tool guide 20 being formed on an upper portion thereof, that is the screw guide 12 and the tool guide 20 are offset relative to axis of the connector 22. The construction connector 20 helps to provide additional spring or compressive force to both the screw guide 12 and the tool guide 20. As can be seen from FIGS. 16, 17 and 22 the tool guide has in rear elevation a figure eight configuration, as does the screw guide and connector in front elevation.

Figure 24:
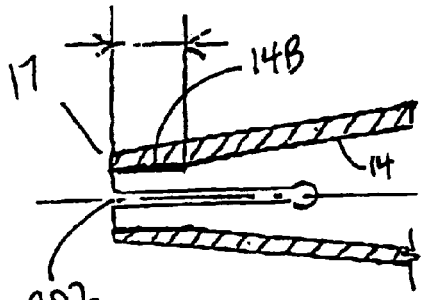
FIG. 24 illustrates a cross section through the screw guide showing the internal construction thereof.

Illustrated in FIG. 24 is a cross section through a screw guide portion of embodiments such as those illustrated in FIGS. 14 to 18 where at least one slit 202 is provided through the body. As can be seen from FIG. 24, the end 17 of frusto-conical cavity 14 terminates in a cylindrical portion 14B. As discussed above, the slit(s) 202 allow the end 17 of the body 12A to expand radially outwardly to allow passage of a screw head. However, the cylindrical portion 14B is of sufficient length so that when the shank of a screw is located therein, two adjacent threads on the shank will be supported by the cylindrical portion 14B to thereby position the axis of rotation of a screw substantially coincident with the axis 18. This also serves to stabilise the screw and helps to minimise a wobble effect and gives better alignment with the screw driver's axis of rotation.

In certain circumstances the screw driver bit will not push through the screw guide body after the screw has exited the screw guide body. This is thought to be because the screw guide body is exerting compressive forces onto the bit, and thee will also be present frictional forces, thereby preventing further engagement of the screw driver with the screw. By this means, the screw alignment device will help to further prevent overtightening of the screw resulting in an optimal torque being applied to the screw.

The embodiments described above which are made of plastic material can be made from polycarbonate plastics, or nylon or any other appropriate material.

It will be appreciated that although the above embodiments have described a tool in the form of a screwdriver, other tools for fastening screws are included within the scope of the invention, such as for example a screw bit connected to a power tool.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

What is claimed is:

1. A screw alignment device for use with a screw driving tool and a screw during a fastening operation, with said screw being of the type having a shank disposed between a screw head and a distal end, the screw driving tool being of the type having a shaft with a gripping formation at one end thereof and a screw engaging formation at the other end thereof for engagement with the screw head, said screw alignment device including:

a screw guide having a body of a generally annular configuration formed from a resilient material and having an internal cavity of generally frusto-conical configuration tapering convergently towards a forward end of the screw guide;

a tool guide spaced rearwardly from the screw guide and aligned generally with an axis of said frusto-conical configuration; and a connector which connects the screw guide to the tool guide and wherein said connector is an elongate shank having an axis parallel to the cone axis;

where, in use, a screw can be located in the screw guide so as to be aligned generally with said axis of said frusto-conical configuration, the distal end of the screw projecting through said forward end and the head of the screw being held by the screw guide, and said tool guide receiving said tool so that when engaged with the screw head, said screw and said tool are releasably held together in substantial alignment, and by driving the screw forwardly into a surface to receive said screw, said head of said screw will cause the screw guide to flex outwardly to permit the screw to pass through the screw guide.

2. A screw alignment device as claimed in claim 1, wherein said screw guide body includes at least one slit there through aligned generally parallel with the axis of said frusto-conical configuration.

3. A screw alignment device as claimed in claim 2, wherein said at least one slit is through said screw guide body along a whole length of said screw guide body.

4. A screw alignment device as claimed in claim 3 wherein a convergent formation is located adjacent said at least one slit to facilitate the entry of a screw into said screw guide.

5. A screw alignment device as claimed in claim 2, said at least one slit is through said screw guide body along a partial length of said screw guide body.

6. A screw alignment device as claimed in claim 1, wherein a tool guide comprises a pair of jaws defining a gap there between in which the shaft of said tool is located and slidably engaged in use.

7. A screw alignment device as claimed in claim 6, wherein said jaws are resiliently able to move apart from each other to increase the width of the gap so as to be able to accommodate a range of shaft diameters.

8. A screw alignment device as claimed in claim 1, wherein said tool guide is adapted to allow the tool to rotate relative to the screw alignment device during a screw driving operation.

9. A screw alignment device as claimed in claim 1 wherein said tool guide is formed of a resilient material such as sheet metal, plastic, moulded plastic.

10. A screw alignment device as claimed in claim 1 wherein a screw loading region is defined between the screw guide and the tool guide, for loading screws into the screw guide.

11. A screw alignment device as claimed in claim 1 wherein said screw guide and the tool guide are formed on the opposite ends of an elongate shank.

12. A screw alignment device as claimed in claim 1 wherein said tool guide includes formations which assist the tool guide in slidably holding the tool guide to a tool.

13. A screw alignment device as claimed in claim 12 wherein said formations include U-shaped formations to wrap partially around the tool.

14. A screw alignment device as claimed in claim 1 wherein there is included on said device a platform means to assist the entry of a screw into said screw guide.

15. A screw alignment guide as claimed in claim 1 wherein said connector is formed with or as part of a, or the, cartridge for holding a supply of screws for use with said device.

16. A screw alignment device as claimed in claim 1 wherein said screw alignment device includes a screw driving tool slidably held in said tool guide.

17. A screw alignment device as claimed in claim 1 wherein said tool guide connector, and said screw guide are located on a cartridge or a housing.

18. A screw alignment device as claimed in claim 1, wherein said tool guide and said connector form a shape similar to a FIG. 8 when viewed in elevation or cross section.

19. A screw alignment device as claimed in claim 1, wherein said screw guide, said tool guide and said connector are integrally formed in a single piece.

20. A screw alignment device as claimed in claim 1, wherein said connector is offset from said screw guide and said tool guide.

21. A screw alignment device as claimed in claim 1, wherein said internal cavity terminates with a cylindrical portion.

22. A screw alignment device for use with a screw driving tool and a screw during a fastening operation, with said screw being of the type having a shank disposed between a screw head and a distal end, the screw driving tool being of the type having a shaft with a gripping formation at one end thereof and a screw engaging formation at the other end thereof for engagement with the screw head, said screw alignment device including:

a screw guide having a body of a generally annular configuration formed from a resilient material and having an internal cavity of generally frusto-conical configuration tapering convergently towards a forward end of the screw guide;

a tool guide spaced rearwardly from the screw guide and aligned generally with an axis of said frusto-conical configuration; and a connector which connects the screw guide to the tool guide;

where, in use, a screw can be located in the screw guide so as to be aligned generally with said axis of said frusto-conical configuration, the distal end of the screw projecting through said forward end and the head of the screw being held by the screw guide, and said tool guide receiving said tool so that when engaged with the screw head, said screw and said tool are releasably held together in substantial alignment, and by driving the screw forwardly into a surface to receive said screw, said head of said screw will cause the screw guide to flex outwardly to permit the screw to pass through the screw guide in combination with a cartridge for presenting a plurality of screws in succession to a screw loading region of said screw alignment device, the cartridge including:

a hollow housing having a screw feed channel within the interior of the housing and defining an opening being provided through a wall of the housing into the channel;

moving means to move screws located in the feed channel towards the opening wherein said moving means is at least one inclined planes associated with said tool housing, said at least one inclined planes engaging a screw in said hollow housing so that as said plane moves towards said screw said screw is moved towards said opening; and connection means for connecting the cartridge to the screw alignment device, where in use, the plurality of screws are stored in individual succession on the screw feed channel so that each successive screw is moved towards the opening for insertion into the screw loading region of the screw alignment device in a fastening operation.

23. A screw alignment device as claimed in claim 22, wherein said moving means includes a biasing means.

24. A screw alignment device as claimed in claim 22, wherein said moving means includes a spring.

25. A screw alignment device as claimed in claim 22, and wherein a second inclined plane acts on a second screw so that as said second inclined plane moves away from said second screw, said second screw will force the first mentioned screw to enter through said opening and be positioned in said alignment device.

26. A screw alignment device as claimed in claim 22, wherein said one or more of said inclined planes are formed on two prongs with a space between said prongs, allowing a shank of said screws to be located in said space.

27. A screw alignment device as claimed in claim 22, wherein one end of said housing is attached to the guide by a locking cap provided with a channel having an axis aligned with the cone axis of the guide when it is located thereon.

28. A screw alignment device as claimed in claim 27, wherein an engaging formation protrudes within the channel in a transverse plane to the axis, for engaging the body of the screw guide.

29. A screw alignment device as claimed in claim 22, wherein said screw carrier means has two oppositely disposed tracks having inner edges that are spaced apart such that the shank of a screw can be located between the tracks and the head of a screw above the tracks.

30. A screw alignment device for use with a screw driving tool and a screw during a fastening operation, with said screw being of the type having a shank disposed between a screw head and a distal end, the screw driving tool being of the type having a shaft with a gripping formation at one end thereof and a screw engaging formation at the other end thereof for engagement with the screw head, said screw alignment device including: a screw guide having a body of a generally annular or frusto-conical configuration formed from a resilient material and having an internal cavity of generally frusto-conical configuration tapering convergently towards a forward end of the screw guide; a tool guide spaced rearwardly from the screw guide and aligned generally with an axis of said frusto-conical configuration said tool guide comprising a pair of jaws defining a gap there between in which the shaft of said tool is located and slidably engaged in use; and a connector which connects the screw guide to the tool guide; where, in use, a screw can be located in the screw guide so as to be aligned generally with said axis of said frusto-conical configuration, the distal end of the screw projecting through said forward end and the head of the screw being held by the screw guide, and said tool guide receiving said tool so that when engaged with the screw head said screw and said tool are releasably held together in substantial alignment, and by driving the screw forwardly into a surface to receive said screw, said head of said screw will cause the screw guide to flex outwardly to permit the screw to pass through the screw guide.

31. A screw alignment device as claimed in claim 30, wherein said jaws are resiliently able to move apart from each other to increase the width of the gap so as to be able to accommodate a range of shaft diameters.

32. A screw alignment device as claimed in claim 30, wherein said tool guide is adapted to hold the screw alignment device to the tool.

33. A screw alignment device as claimed in claim 30, wherein said tool guide is adapted to allow the tool to rotate relative to the screw alignment device during a screw driving operation.

* * * * *